US006984457B2

(12) United States Patent
Yamamoto et al.

(10) Patent No.: US 6,984,457 B2
(45) Date of Patent: Jan. 10, 2006

(54) TITANIUM MATERIAL, PRODUCTION THEREOF, AND EXHAUST PIPE

(75) Inventors: Kenji Yamamoto, Kobe (JP); Wataru Urushihara, Kobe (JP); Takashi Yashiki, Osaka (JP)

(73) Assignee: Kobe Steel Ltd., Kobe (JP)

( * ) Notice: Subject to any disclaimer, the term of this patent is extended or adjusted under 35 U.S.C. 154(b) by 101 days.

(21) Appl. No.: 10/872,566

(22) Filed: Jun. 22, 2004

(65) Prior Publication Data

US 2004/0265619 A1 Dec. 30, 2004

(30) Foreign Application Priority Data

Jun. 27, 2003 (JP) ..... 2003-185309
Apr. 28, 2004 (JP) ..... 2004-133867

(51) Int. Cl.
*B32B 15/20* (2006.01)
*B05D 1/18* (2006.01)

(52) U.S. Cl. ..... 428/651; 428/660; 428/926; 428/939; 138/145; 138/146; 148/519; 148/535

(58) Field of Classification Search ..... 428/651, 428/660, 926, 939; 29/890.08; 138/145, 146; 148/237, 519, 535, 317
See application file for complete search history.

(56) References Cited

U.S. PATENT DOCUMENTS 3,881,880 A 5/1975 Gomersall
4,046,304 A 9/1977 Tabata et al.
4,891,274 A 1/1990 Higuchi et al.
6,207,299 B1 3/2001 Krauth et al.

FOREIGN PATENT DOCUMENTS

| | | |
|---|---|---|
| EP | 0 348 575 | 1/1990 |
| JP | 6-88208 | 3/1994 |
| JP | 9-256138 | 9/1997 |
| JP | 10-99976 | 4/1998 |

*Primary Examiner*—Robert R. Koehler
(74) *Attorney, Agent, or Firm*—Oblon, Spivak, McClelland, Maier & Neustadt, P.C.

(57) ABSTRACT

(1) A titanium material composed of a substrate of pure titanium or titanium alloy and an aluminum-containing layer formed thereon having a thickness no smaller than 1 μm and containing no less than 90 mass % aluminum or aluminum plus silicon. (2) A titanium material composed of a substrate of pure titanium or titanium alloy and an aluminum-containing layer formed thereon having a thickness no smaller than 1 μm and containing no less than 90 mass % aluminum or aluminum plus silicon, with a layer of Al—Ti intermetallic compound interposed between them. (3) A titanium material as defined in (1) wherein the substrate contains 0.5–10 mass % aluminum. (4) A titanium material as defined in (1) wherein that surface of the substrate with which the aluminum-containing layer is in contact contains 20–50 atomic % nitrogen. (5) A titanium material as defined in (1) wherein a layer of aluminum nitride is formed in the interface between the substrate and the aluminum-containing layer. (6) An exhaust pipe for two- or four-wheeled vehicles which is made of the titanium material defined above.

14 Claims, 1 Drawing Sheet

TITANIUM MATERIAL, PRODUCTION THEREOF, AND EXHAUST PIPE

BACKGROUND OF THE INVENTION

1. Field of the Invention

The present invention relates to a titanium material, a method for production thereof, and an exhaust pipe. More particularly, the present invention relates to a titanium material from which to make an exhaust pipe for two- or four-wheeled vehicles.

2. Description of the Related Art

By virtue of their higher specific strength than ordinary steels, titanium alloys are making inroads in the field of transportation, particularly automobiles requiring weight reduction. One way under study to realize weight reduction is by replacement of prevailing stainless steel exhaust pipes with titanium alloy ones. Unfortunately, exhaust pipes get hot partly above 500° C. and titanium alloys (without special treatment) are subject to rapid oxidation at such high temperatures, which poses a problem with durability.

Some ideas have been proposed to improve the oxidation resistance of titanium alloys. They include an aluminum-clad titanium alloy material (Japanese Patent Laid-open No. Hei-10-99976), a method for plating by vapor deposition with Al—Ti alloy (Japanese Patent Laid-open No. Hei-6-88208), and a method of forming a TiCrAlN film by PVD (Japanese Patent Laid-open No. Hei-9-256138). Unfortunately, cladding involves complex processes, which leads to high production cost and poor economy. In addition, vapor deposition and PVD present difficulties in forming oxidation-resistant film inside an exhaust pipe.

OBJECT AND SUMMARY OF THE INVENTION

The present invention was completed in view of the foregoing. It is an object of the present invention to provide a titanium material with good oxidation resistance and an exhaust pipe made thereof, which will solve problems involved in the prior art technology mentioned above.

The titanium material according to the present invention is composed of a substrate of pure titanium or titanium alloy and an aluminum layer no thinner than 1 $\mu$m which contains no less than 90 mass % of aluminum or aluminum plus silicon. The aluminum layer may be formed on the substrate directly or indirectly with a layer of Al—Ti intermetallic compound interposed between them.

In the case where an intermediate layer is used, the Al—Ti intermetallic compound should preferably be $Al_3Ti$ and the layer thickness should be no smaller than 0.5 $\mu$m and no larger than 1.5 $\mu$m on average.

The titanium material according to the present invention may be embodied such that the substrate is a titanium alloy containing aluminum in an amount of 0.5–10 mass %. In this case, the substrate may be a titanium alloy composed substantially of aluminum and titanium.

The titanium material according to the present invention may be embodied such that the surface layer of the substrate with which the aluminum-containing layer is in contact contains nitrogen in an amount of 20–50 at %.

The titanium material according to the present invention may be embodied such that an intermediate layer of aluminum nitride is formed between the substrate and the aluminum-containing layer.

The titanium material according to the present invention may be embodied such that the aluminum-containing layer is formed by hot-dip plating.

The titanium material according to the present invention may be embodied such that the aluminum-containing layer has a limited thickness variation which is defined as follows. When the thickness is measured at three points (14 mm apart) selected in the lengthwise direction of the titanium material on the aluminum-containing layer, the difference between the thickness at the middle point and the thickness at the outer two points is no larger than 30% of the thickness at the middle point. The titanium material constructed in this way is obtained by forming the aluminum-containing layer by hot-dip plating (which involves dipping the substrate in a plating bath of molten metal). In this case, the substrate should be pulled up from the plating bath at a rate of 1–20 cm/s.

The titanium material according to the present invention may be produced in such a way that the aluminum-containing layer is formed by hot-dip plating (which involves dipping the substrate in a plating bath of molten metal) and then subjected to shot blasting with hard particles.

An exhaust pipe made of the titanium material of the present invention is also within the scope of the present invention.

The titanium material according to the present invention is superior in oxidation resistance and can be applied easily to the pipe inside having a complex shape. Therefore, it will find use as a material for durable exhaust pipes of two- or four-wheeled vehicles.

The exhaust pipe according to the present invention, which is made of the titanium material mentioned above, is light in weight and has good oxidation resistance which leads to improved durability.

The production method according to the present invention gives a titanium material with outstanding oxidation resistance.

DESCRIPTION OF THE PREFERRED EMBODIMENTS

Figure 1:
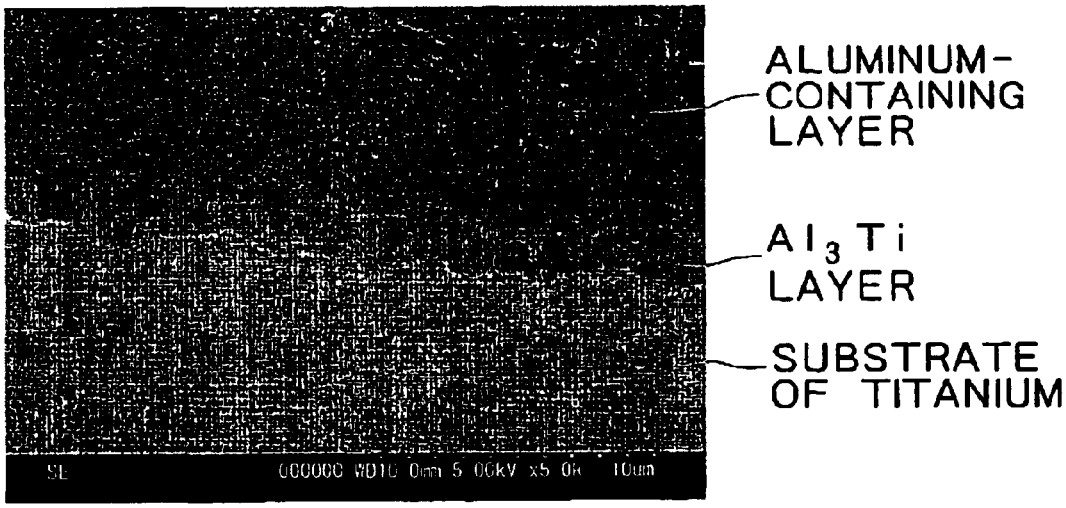
FIG. 1 is a photograph showing the titanium material pertaining to one embodiment of the present invention in which there is an intermediate $Al_3Ti$ layer formed between the titanium substrate and the aluminum-containing layer.

The first aspect of the present invention covers a titanium material which is composed of a substrate of pure titanium or titanium alloy and an aluminum-containing layer no thinner than 1 $\mu$m containing no less than 90 mass % aluminum or aluminum plus silicon.

The titanium material is endowed with improved oxidation resistance by the aluminum-containing layer which produces anti-oxidant actions. For the aluminum-containing layer to contribute to oxidation resistance, it should be in the form of a layer no thinner than 1 $\mu$m and containing no less than 90 mass % aluminum or aluminum plus silicon, which is formed on the substrate of pure titanium or titanium alloy. The reason for this is that aluminum or an aluminum alloy with a high aluminum content preferentially forms a compact aluminum oxide (which has a large negative value of free energy of formation) in an oxidative atmosphere at a high temperature, and this aluminum oxide functions as a protective film which prevents further oxidation. Incidentally, silicon is an element to improve oxidation resistance and hence silicon contained in the aluminum-containing layer improves its oxidation resistance. In the case where silicon is contained in the aluminum-containing layer, the total amount of aluminum and silicon should be no less than 90 mass % of the aluminum-containing layer.

The aluminum-containing layer (or the oxidation resistance improving layer) should contain aluminum or aluminum plus silicon in an amount no less than 90 mass %. Any amount less than 90 mass % is not enough to produce the desired effect of oxidation resistance.

In the case where the aluminum-containing layer contains silicon, the amount of silicon should preferably be 1–20 mass % of the total amount (100 mass %) of aluminum plus silicon. With an amount less than 1 mass %, silicon does not produce the effect of improving oxidation resistance. With an amount more than 20 mass %, silicon will present difficulties with the hot-dip plating by which the aluminum-containing layer is formed. Therefore, it is most desirable that silicon accounts for about 10% in the total amount of aluminum and silicon.

The aluminum-containing layer (composed of aluminum alone or aluminum plus silicon) may inevitably contain other elements than aluminum and silicon. They include magnesium, copper, iron, etc. (originating from hot-dip plating) and titanium (originating from the substrate composed of pure titanium or titanium alloy).

The aluminum-containing layer should have a thickness no thinner than 1 $\mu$m; otherwise, it would have pinholes that cause oxidation to the substrate. There is no upper limit to thickness because it produces a better antioxidant effect in proportion to thickness unless it has pinholes. However, an excessively thick layer makes the substrate poor in workability. Therefore, an adequate thickness should be less than about 100 $\mu$m. Incidentally, the thickness of the aluminum-containing layer should be determined by an average of measurements at arbitrary points (say, three points) along the cross section of the titanium material.

The aluminum-containing layer should preferably be formed by hot-dip plating, which is capable of forming a uniform layer on a complex shape (such as the inside of a pipe) and is fairly economical. Hot-dip plating offers another advantage of reducing the natural oxide film on the surface of the substrate (of pure titanium or titanium alloy) during dipping in molten aluminum, thereby improving adhesion between the substrate and the aluminum-containing layer. Hot-dip plating should preferably be carried out such that the bath temperature is 700–800° C. and the dipping time is 5–20 minutes. However, this condition will vary depending on the kind and heat capacity of the substrate.

In addition, it is also possible to form the aluminum-containing layer on the substrate by coating the substrate with an organic paint containing aluminum flakes.

As mentioned above, the titanium material pertaining to the first aspect of the present invention is superior in oxidation resistance and can be produced by hot-dip plating which permits the oxidation resistance improving layer to be formed on a complex shape (such as the inside of a pipe) easily and economically. In other words, it helps solve problems with the conventional technology and it exhibits outstanding oxidation resistance.

If the substrate of pure titanium or titanium alloy (which are collectively referred to as titanium hereinafter) is to be tightly covered with the aluminum-containing layer, it is necessary to clean the substrate surface of oxide film. Titanium is usually covered with natural oxide film which has a thickness of tens of nanometers. Dipping titanium in molten aluminum at a high temperature removes oxide film by reduction reaction represented by $3TiO_2+4Al \rightarrow 2Al_2O_3+3Ti$. Simple dipping may not provide sufficient adhesion. In this case, good adhesion is obtained by repeating dipping in the plating bath of molten aluminum, because such repeated dipping forms an Al—Ti intermetallic compound by reaction between titanium and molten aluminum. In other words, it is possible to achieve high adhesion between the substrate and the aluminum-containing layer if the substrate is previously covered with a layer of Al—Ti intermetallic compound and then the aluminum-containing layer is formed thereon.

Removal of natural oxide film by reduction may be accomplished by, for example, dipping the substrate in molten aluminum so that that natural oxide film reacts with molten aluminum. Therefore, if the substrate is dipped in molten aluminum for a sufficiently long time, natural oxide film is removed by reduction and then a layer of Al—Ti intermetallic compound is formed.

The second aspect of the present invention covers a titanium material which is composed of a substrate of pure titanium or titanium alloy and an aluminum-containing layer no thinner than 1 $\mu$m formed thereon which contains no less than 90 mass % aluminum or aluminum plus silicon, with an interlayer of Al—Ti intermetallic compound interposed between them. As compared with the titanium material according to the first aspect of the present invention, the one according to the second aspect of the present invention is better in adhesion between the substrate and the aluminum-containing layer. In other words, the interlayer ensures firm adhesion with a minimum of adhesion failure.

The finding that outstanding adhesion is achieved when the Al—Ti intermetallic compound is $Al_3Ti$ has lead to the third aspect of the present invention. Thus, according to the third aspect of the present invention, the titanium material defined in the second aspect of the present invention is characterized in that the Al—Ti intermetallic compound (in the layer of Al—Ti intermetallic compound) is $Al_3Ti$. This titanium material exhibits outstanding adhesion for the reasons mentioned above.

Incidentally, Al—Ti intermetallic compounds include $Ti_3Al$, TiAl, and $Al_3Ti$. The former two are so brittle that they cause defective adhesion if they occur in the inter-face between the substrate (of pure titanium or titanium alloy) and the aluminum-containing layer. There has been known a method of improving adhesion by cladding a titanium plate with an aluminum foil and then forming an intermetallic compound in the interface by heat treatment for solid-phase reaction. This conventional method, however, permits the formation of $Ti_3Al$ and TiAl in the interface, thereby causing defective adhesion.

The third aspect of the present invention requires that the $Al_3Ti$ layer be formed on the substrate (titanium) or in the interface between the substrate and the aluminum-containing layer. The present inventors succeeded in forming the $Al_3Ti$ layer as required. In other words, they succeeded in forming the $Al_3Ti$ layer composed of $Al_3Ti$ alone (without $Ti_3Al$ and TiAl) in the interface between the substrate and the aluminum-containing layer by hot-dip plating, with the dipping time and bath temperature adequately controlled. (The mechanism of reactions involved is not known.) The dipping time and bath temperature for molten aluminum vary depending on the mass of the substrate (titanium) to be treated. The duration of dipping is about 2–10 minutes, and the bath temperature is about 700–800° C.

According to the fourth aspect of the present invention, the layer of Al—Ti intermetallic compound should preferably have an average thickness no smaller than 0.5 μm and no larger than 15 μm. The thickness of the layer of Al—Ti intermetallic compound (such as $Al_3Ti$) can be controlled by adjusting the duration of dipping and the bath temperature at the time of hot-dip plating. It becomes larger in proportion to the duration of dipping and the bath temperature. In the case of excessively large thickness, the aluminum-containing layer (which is responsible for oxidation resistance) becomes thin on account of mutual diffusion between the substrate (titanium) and the aluminum-containing layer, and adhesion of the aluminum-containing layer deteriorates. Therefore, the layer of Al—Ti intermetallic compound should not be thicker than 15 μm. On the other hand, in the case of excessively small thickness, the layer of Al—Ti intermetallic compound does not improve adhesion as required. Therefore, the layer of Al—Ti intermetallic compound should not be thinner than 0.5 μm. Incidentally, the thickness of the layer of Al—Ti intermetallic compound is determined by an average of measurements at arbitrary points (say, three points) along the cross section of the titanium material. This measurement may be accomplished by observation under an SEM (with a magnification of 5000). The composition (in terms of the amount of Al and Ti) of the Al—Ti intermetallic compound may be determined by EPMA, for example. Incidentally, the layer of Al—Ti intermetallic compound should preferably have an average thickness no smaller than 1 μm and no larger than 5 μm.

In the present invention, the substrate (of pure titanium or titanium alloy) is not specifically restricted and it may largely vary in composition. A substrate containing aluminum will exhibit improved adhesion with the aluminum-containing layer responsible for oxidation resistance. The improved adhesion prevents the aluminum-containing layer from peeling off when the titanium material is bent after the aluminum-containing layer has been formed thereon. The content of aluminum in the substrate necessary for improved adhesion is no less than 0.5 mass %. A content less than 0.5 mass % is not enough for improved adhesion. With a content exceeding 0.5 mass %, aluminum produces no effect on adhesion improvement. In addition too much Al content makes the substrate brittle. Therefore, the aluminum content should be less than 10 mass %. Thus, the fifth aspect of the present invention requires that the aluminum content in the substrate should be 0.5–10 mass %.

In the case where the substrate contains 0.5–10 mass % aluminum, the remainder of the constituents (other than aluminum) should substantially be titanium, so that the resulting titanium material has good workability. Thus, the sixth aspect of the present invention requires that the substrate should be composed substantially of titanium and aluminum. "Substantially" in this case means that titanium may be a titanium alloy containing inevitable impurities.

The titanium material according to the present invention may be composed of a substrate and an aluminum-containing layer such that (1) the surface (and its vicinity) of the substrate with which the aluminum-containing layer is in contact contains as much nitrogen as 20–50 atomic % or (2) a layer of aluminum nitride is formed in the interface between the substrate and the aluminum-containing layer. Such construction prevents reactions due to mutual diffusion between the substrate and the aluminum-containing layer. This reduces the loss of the aluminum-containing layer and maintains the effect of oxidation resistance for a long period of time. That is, in this way, the titanium material keeps its good oxidation resistance for a long period of time. The mechanism for improvement in oxidation resistance is as follows.

An ordinary substrate (other than those mentioned above) having the aluminum-containing layer in direct contact therewith permits mutual diffusion of elements between the substrate and the aluminum-containing layer at high temperatures. As the result after a long time, the aluminum-containing layer disappears or oxidation resistance is lost. This is not the case if the surface of the substrate contains nitrogen even though the substrate is in direct contact with the aluminum-containing layer. The reason for this is that elements in the substrate and elements in the aluminum-containing layer mutually diffuse at high temperatures. This thermal diffusion brings about reaction between nitrogen in the surface layer of the substrate and aluminum in the aluminum-containing layer, thereby giving rise to a layer of aluminum nitride in the interface between the substrate and the aluminum-containing layer. This aluminum nitride layer prevents the further diffusion of elements between the substrate and the aluminum-containing layer.

As mentioned above, nitrogen contained in the surface layer of the substrate forms at high temperatures an aluminum nitride layer in the interface between the substrate and the aluminum-containing layer. The aluminum nitride layer may be naturally formed while the titanium material (with an aluminum-containing layer formed thereon) is being used at high temperatures. It may also be intentionally formed by forming an aluminum-containing layer on the substrate and then performing heat treatment. If the content of nitrogen in the surface layer of the substrate is less than 20 atomic %, the resulting aluminum nitride layer does not achieve its object for protection. The upper limit of nitrogen content is 50 atomic %, because titanium becomes saturated with 50 atomic % nitrogen in the form of TiN. Incidentally, the titanium material composed of a substrate and an aluminum-containing layer formed thereon, which is not yet heated, has a nitrogen-containing layer on the substrate but has no aluminum nitride layer due to thermal diffusion and there exists an extremely thin layer of nitrogen in the interface between the substrate and the aluminum-containing layer.

Thus, the titanium material according to the seventh aspect of the present invention is characterized in that the surface layer of the substrate with which the aluminum-containing layer is in contact contains as much nitrogen as 20–50 atomic %. And, the titanium material according to the eighth aspect of the present invention is characterized in that an aluminum nitride layer is formed in the interface between the substrate and the aluminum-containing layer.

As will be apparent from the foregoing, the titanium material pertaining to the eighth aspect of the present invention offers the following advantages. The aluminum nitride layer functions as a protective layer that prevents mutual diffusion of elements between the substrate and the aluminum-containing layer. This protective layer retains the aluminum-containing layer and good oxidation resistance. For this reason, the titanium material has improved oxidation resistance, keeps good oxidation resistance in a high-temperature atmosphere, and keeps good oxidation resistance for a long period of time.

As will be apparent from the foregoing, the titanium material pertaining to the seventh aspect of the present invention offers the following advantages. An aluminum nitride layer is formed in the interface between the substrate and the aluminum-containing layer while the titanium material is being used at high temperatures. The aluminum nitride layer functions as a protective layer that prevents mutual diffusion of elements between the substrate and the aluminum-containing layer. This protective layer retains the aluminum-containing layer and good oxidation resistance.

For this reason, the titanium material has improved oxidation resistance, keeps good oxidation resistance in a high-temperature atmosphere, and keeps good oxidation resistance for a long period of time. Incidentally, the titanium material on which the aluminum nitride layer is not yet formed is composed of a substrate (whose surface layer contains nitrogen) and an aluminum-containing layer. The titanium material on which the aluminum nitride layer has been formed is composed of a substrate (whose surface layer contains nitrogen or does not contain nitrogen), an aluminum nitride layer, and an aluminum-containing layer.

The amount of nitrogen in the surface layer of the substrate may be determined by using EPMA in combination with any of Auger, XPS, and SIMS.

The aluminum nitride layer formed by heat treatment should have a thickness of tens of nanometers to several nanometers. The one with an excessively small thickness does not produce the barrier effect (to prevent mutual diffusion of elements between the substrate and the aluminum containing layer). The one with an excessively large thickness is poor in workability.

According to the present invention, the aluminum-containing layer (to improve oxidation resistance) may be formed by surface treatment. In other words, the titanium material of the present invention may be said to be a surface-treated titanium material. The method for surface treatment is not specifically restricted, and various methods may be used. They include, for example, hot-dip plating and coating with an organic paint containing aluminum flakes. Incidentally, cladding with an aluminum sheet does not fall under the category of surface treatment. There are many methods for surface treatment to form the aluminum-containing layer. Hot-dip plating is recommendable above all. Hot-dip plating is capable of forming a uniform layer on any complex shape, such as the inside of a pipe. It is also inexpensive and economical. Another advantage of hot-dip plating is that when the substrate is dipped in molten aluminum, natural oxide film on the surface of the substrate (of pure titanium or titanium alloy) is reduced, which provides good adhesion between the substrate and the aluminum-containing layer. Moreover, hot-dip plating forms a layer of Al—Ti intermetallic compound on the substrate under certain conditions (such as duration of dipping in molten aluminum). Therefore, a single step of hot-dip plating can yield the titanium material pertaining to the second aspect of the present invention or the titanium material pertaining to the third and fourth aspects of the present invention. For this reason, it is desirable that the aluminum-containing layer should be formed by hot-dip plating according to the ninth aspect of the present invention.

According to the present invention, hot-dip plating is recommended as one way of forming the aluminum-containing layer. The resulting aluminum-containing layer varies in its characteristic properties (such as adhesion and thickness) depending on the duration of dipping as well as the rate at which the substrate is pulled up from the plating bath. Therefore, it is desirable that the titanium substrate should be pulled up from the plating bath at a rate of 1–20 cm/s according to the eleventh aspect of the present invention. The reason for this is explained below.

Hot-dip plating forms the aluminum-containing layer which varies in thickness depending on position if the substrate is pulled up at an exceedingly high rate. As the substrate is pulled up, molten aluminum sticking to the substrate flows downward until the substrate gets cooled. Thus, the resulting film is thicker at the lower part than at the upper part.

If the rate of pulling up is lower than 20 cm/s, molten aluminum flows down faster than this rate and returns to the plating bath. Thus, no difference occurs in thickness between the upper and lower parts of the substrate. For this reason, it is desirable that the substrate should be pulled up at a rate lower than 20 cm/s.

If the rate of pulling up is 1 cm/s, it takes 100 seconds for a 1-meter long substrate to be pulled up. This means that the duration of dipping greatly varies from the upper part to the lower part. (The duration of dipping is usually 1–2 minutes.) Prolonged dipping promotes reaction between the titanium substrate and the molten aluminum, thereby reducing the thickness of the titanium substrate. For this reason, the rate of pulling up should be larger than 1 cm/s.

Moreover, the rate of pulling up should preferably be in the range of 2–15 cm/s, so as to reduce variation in coating thickness and to prevent the titanium substrate from getting thin.

In the case where the titanium substrate is pulled up from the plating bath at a rate of 1–20 cm/s as mentioned above, the aluminum-containing layer formed thereon has limited variation in thickness from the upper part to the lower part. The thickness variation is defined as follows. When the thickness is measured at three points (14 mm apart) selected in the lengthwise direction of the titanium material on the aluminum-containing layer, the difference between the thickness at the middle point and the thickness at the outer two points is no larger than 30% of the thickness at the middle point. The titanium material as specified above has the aluminum-containing layer formed thereon which is uniform in thickness. Therefore, it has uniform oxidation resistance and accurate thickness, as the tenth aspect of the present invention defines.

The aluminum-containing layer formed by hot-dip plating might have voids or might be discontinuous, which varies depending on the state of the substrate and the rate of pulling up of the substrate from the plating bath. While solidifying on the titanium substrate, molten aluminum reacts with atmospheric air to form a thin oxide film on its outer surface. This oxide film diminishes the surface gloss. The present inventors conducted extensive studies to tackle this problem. As the result, it was found that the aluminum-containing layer is recovered from defects (such as voids and discontinuous parts) if it undergoes shot blasting with hard particles (such as tiny glass or metal balls) after it has been formed by hot-dip plating. This leads to improved oxidation resistance. It was also found that such shot blasting removes the surface oxide film and imparts a metallic luster to the surface. The oxide film to be removed by shot blasting is much thicker than natural oxide film because it involves the oxide film formed on the surface of molten aluminum when the substrate is pulled up from the plating bath. After such a thick oxide film has been removed by shot blasting, a very thin natural oxide film is formed, which does not impair the glossy surface.

Therefore, according to the twelfth aspect of the present invention, it is desirable that the aluminum-containing layer should undergo shot blasting with hard particles after it has been formed by hot-dip plating. Such shot blasting remedies defects in the aluminum-containing layer, thereby improving its oxidation resistance. Moreover, such shot blasting removes surface oxide film, thereby producing a metallic luster.

The shot blasting mentioned above employs hard particles with a higher hardness than aluminum. However, excessively hard particles abrade the aluminum-containing layer.

An adequate hardness of the hard particles should be lower than the hardness of alumina, preferably lower than the hardness of glass. The hard particles should have a particle size of #100, which is common to ordinary shot blasting. This particle size is equivalent to a particle diameter of hundreds of micrometers. A particle diameter larger than 10 μm is desirable, because excessively small particles do not effectively fill voids by impact. Shot blasting may be accomplished most easily by ejecting hard particles by compressed air. The air pressure should be lower than 5 kg/cm$^2$, preferably lower than 3 kg/cm$^2$. Shot blasting with an excessively high air pressure scrapes off the aluminum-containing layer.

As mentioned above, the titanium material pertaining to the first to tenth aspects of the present invention is superior in oxidation resistance and is obtained by surface treatment (such as hot-dip plating) which permits the oxidation resistance layer to be formed economically and easily on a complex shape such as the inside of a pipe. Therefore, it will find use as a constituent of the durable exhaust pipe for two- and four-wheeled vehicles, as defined in the thirteenth aspect of the present invention.

In the case where the titanium material of the present invention is applied to the exhaust pipe, it is desirable that the aluminum-containing layer should be formed on both sides of the exhaust pipe. In addition, the aluminum-containing layer may be formed before or after the substrate has been formed into a pipe.

EXAMPLES

The invention will be described in more detail with reference to the following Examples and Comparative Examples, which are not intended to restrict the scope thereof. Various changes and modifications may be made in the invention without departing from the spirit and scope thereof.

Example 1 and Comparative Example 1

Samples of the titanium material with an aluminum-containing layer (for oxidation resistance) having the composition shown in Table 1 were prepared from a substrate of pure titanium (JIS Type 1, 1 mm thick) by hot-dip plating, vapor deposition, or spraying with a paint containing aluminum particles. To form the aluminum-containing layer, hot-dip plating was accomplished by dipping the substrate in molten aluminum such that the bath temperature was 700–750° C. and the duration of dipping was 5–20 minutes.

Not all the samples have an interlayer of Al—Ti intermetallic compound which is formed in the interface between the substrate and the aluminum-containing layer. Each sample was analyzed by EPMA to see if the interlayer exists.

Incidentally, Table 1 shows (in the column of composition) the composition of the aluminum-containing layer. The designation of $Al_{100}$ for Sample Nos. 2 and 3 indicates that they are composed of 100 mass % aluminum and inevitable impurities. The designation of $Al_{95}Ti_5$ for Sample No. 4 indicates that it is composed of 95 mass % aluminum and 5 mass % titanium and inevitable impurities. The designation of $Al_{95}Si_5$ for Sample No. 6 indicates that it is composed of 95 mass % aluminum and 5 mass % silicon and inevitable impurities. Other compositions in Tables 2 and 3 should be interpreted in the same way as above.

The composition of the aluminum-containing layer may be adjusted by regulating the amount of silicon or iron to be added to the plating bath in the case of hot-dip plating or by regulating the amount of components to be evaporated in the case of vapor deposition.

The titanium materials obtained in this manner were exposed to the atmosphere at 800° C. for 100 hours for high-temperature oxidation test. Their thickness was measured before and after the test, and the loss of thickness due to oxidation was calculated. In this way the samples were evaluated for oxidation resistance. The high-temperature oxidation test was also performed on pure titanium in the same way as mentioned above so as to evaluate its oxidation resistance.

The results are shown in Table 1. It is noted from Table 1 that Sample No. 1 (pure titanium without the oxidation resistance layer) decreased in thickness by 200 μm due to oxidation by the high-temperature oxidation test. This suggests poor oxidation resistance. Sample No. 5 (for comparison) decreased in thickness by 150 μm . This suggests a slight improvement in oxidation resistance.

By contrast, Sample No. 7 decreased in thickness by less amount. This suggests good oxidation resistance. Sample Nos. 2, 3, 4, 6, and 8 decreased in thickness by much smaller amount. This suggests very good oxidation resistance.

It is noted that Sample Nos. 2, 3, 4, 6, and 8 have better oxidation resistance (or suffers less decrease in thickness) according as the total amount of aluminum and silicon (or the amount of aluminum alone if silicon is not contained) increases in the aluminum-containing layer.

It is noted that Sample No. 5 (for comparison), which contains an excessively large amount of titanium in the aluminum-containing layer, greatly decreased in thickness because coarse titanium oxide preferentially crystallized out in place of protective aluminum oxide.

Example 2

Samples of the titanium material with an aluminum-containing layer (for oxidation resistance) were prepared from a substrate of pure titanium (JIS Type 1, 1 mm thick) and a substrate of titanium alloy containing aluminum (with varied aluminum content) by hot-dip plating. The aluminum-containing layer has the composition represented by $Al_{100}$ as shown in Table 2; that is, it is composed of 100 mass % aluminum. Hot-dip plating was accomplished in the same way as in Example 1. In Table 2, the column of substrate shows the composition of the substrate. The designation of Ti-1.5Al indicates that the substrate is a titanium alloy composed of titanium and 1.5 mass % aluminum, with the balance being inevitable impurities. Other compositions in Tables 2 and 3 should be interpreted in the same way as above.

The titanium material obtained in this manner underwent 90° bending test that causes peeling at the corner. Adhesion between the substrate and the aluminum-containing layer was evaluated from the degree of peeling.

The titanium material which had undergone 90° bending test underwent the high-temperature oxidation test in the same way as in Example 1. Oxidation resistance of the sample was evaluated in the same way as mentioned above.

The results are shown in Table 2. It is noted from Table 2 that Sample No. 6 (for comparison), in which the substrate is a titanium alloy represented by Ti-15Al (composed of titanium and 15 mass % aluminum), suffered cracking in the substrate in the bending test. It is also noted that Sample No. 1, in which the substrate is pure titanium, did not suffer cracking in the substrate but suffered peeling.

By contrast, Sample Nos. 2 to 5, in which the substrate is a titanium alloy containing 0.5–10 mass % aluminum, did not suffer peeling in the bending test. This suggests good adhesion between the substrate and the aluminum-containing layer.

Incidentally, all of Sample Nos. 2 to 5 are found to be superior in oxidation resistance with very little loss in thickness. They are almost the same in oxidation resistance with a small difference in thickness decrease.

Example 3

A substrate of pure titanium (JIS Type 1, 1 mm thick) and a substrate of Ti-1.5Al alloy underwent ion nitridation so that a nitrogen-containing layer was formed on the outer surface of the substrate. The content of nitrogen in the nitrogen-containing layer was varied and determined by EPMA.

Samples of the titanium material with an aluminum-containing layer (for oxidation resistance) were prepared by hot-dip plating from the substrate on which the nitrogen-containing layer had been formed. The aluminum-containing layer has the composition represented by $Al_{100}$ as shown in Table 3; that is, it is composed of 100 mass % aluminum. Hot-dip plating was accomplished in the same way as in Example 1.

The titanium materials obtained in this manner were examined for oxidation resistance by the high-temperature oxidation test in the same way as in Example 1. In some samples, a layer of aluminum nitride is formed in the interface between the substrate and the aluminum-containing layer during heating in the high-temperature oxidation test. To confirm the presence or absence of the aluminum nitride layer, a sample of the same titanium material as mentioned above was heated in the same way as in the high-temperature oxidation test and then cooled, and the cross section of the cooled sample was examined with a TEM (transmission electron microscope).

The results are shown in Table 3. It is noted from Table 3 that Sample Nos. 1 and 7, which had no nitrogen-containing layer on the surface layer of the substrate, formed no aluminum nitride layer at all in the interface between the substrate and the aluminum-containing layer (for oxidation resistance) in the high-temperature oxidation test, regardless of whether the substrate is pure titanium or Ti-1.5Al alloy. It is also noted that Sample Nos. 2, 3, 8 and 9 did not form aluminum nitride layer in the interface between the substrate and the aluminum-containing layer during the high-temperature oxidation test, if the nitrogen content is 2–15 atomic % (not meeting the requirement for 20–50 atomic %) in the nitrogen-containing layer on the surface of the substrate.

Sample Nos. 2, 3, 8, and 9 decreased in thickness due to oxidation by the high-temperature oxidation test as shown in Table 3.

By contrast, Sample Nos. 4 to 6 and 10 to 12 gave rise to an aluminum nitride layer in the interface between the substrate and the aluminum-containing layer during heating in the high-temperature oxidation test, because a nitrogen-containing layer containing 27–48 atomic % nitrogen (which meets the requirement for 20–50 atomic %) is formed on the surface of the substrate.

Sample Nos. 4 to 6 and 10 to 12 gave the results in the high-temperature oxidation test as shown in Table 3. Sample Nos. 4 to 6 and 10 to 12 are superior in oxidation resistance (with a small thickness decrease due to oxidation in the high-temperature oxidation test) to Sample Nos. 2, 3, 8, and 9, in which the nitrogen-containing layer is absent or the nitrogen content in the nitrogen-containing layer is 2–15 atomic %.

These titanium materials (Sample Nos. 4 to 6, and 12 to 12) increase in oxidation resistance and decrease in loss of thickness due to oxidation in the high-temperature oxidation test according as the content of nitrogen increases in the nitrogen-containing layer formed on the surface of the substrate.

Example 4 and Comparative Example 2

Samples of the titanium material with an aluminum-containing layer (for oxidation resistance) were prepared from a substrate of pure titanium (JIS Type 1, 1 mm thick) by hot-dip plating. Hot-dip plating was accomplished by dipping the substrate in molten aluminum such that the bath temperature was 750° C. and the duration of dipping ranged from 0.1 to 60 minutes. Not all the samples have an interlayer of Al—Ti intermetallic compound which is formed in the interface between the substrate and the aluminum-containing layer. Each sample was analyzed by EPMA (in the same way as in Example 1) to see if the interlayer exists.

The substrate of pure titanium was clad with an aluminum sheet to give an aluminum-clad titanium material. This product was heated in the atmosphere at 500° C. for 60 minutes to form a layer of Al—Ti intermetallic compound in the interface between the substrate (of pure titanium) and the aluminum sheet. The resulting product was examined for elemental analysis by EPMA in the same way as mentioned above in order to confirm the presence of the layer of intermetallic compound.

The thus obtained titanium material underwent 90° bending test. Adhesion between the substrate and the aluminum-containing layer or the aluminum sheet was evaluated from the degree of peeling at the corner.

After the bending test, the titanium material under-went the high-temperature oxidation test (in the atmosphere at 800° C. for 100 hours) in the same way as in Example 1. The oxidation resistance of the sample was evaluated from the amount of decrease in thickness at the bent part due to oxidation in the high-temperature oxidation test.

The results are shown in Table 4. FIG. 1 is an electron micrograph showing the interface (and its vicinity) between the substrate and the aluminum-containing layer. This photograph was taken after hot-dip plating and before bending test. The specimen for FIG. 1 was taken from Sample No. 3 specified in Table 4. It is noted from FIG. 1 that the titanium material is composed of the substrate and the aluminum-containing layer, with the interlayer of $Al_3Ti$ interposed between them.

It is noted from Table 4 that Sample No. 1, which was produced by dipping the substrate (of pure titanium) in the plating bath for 0.1 minutes, did not give a layer of intermetallic compound in the interface between the substrate and the aluminum-containing layer, and it also retained an oxide film on the surface of the substrate.

By contrast, Sample Nos. 2 to 6 and 8, for which the duration of dipping was extended, gave a layer of intermetallic compound ($Al_3Ti$) in the interface between the substrate and the aluminum-containing layer. It is also noted that the $Al_3Ti$ layer becomes thicker according as the during of dipping increases.

Sample No. 1, which lacks the layer of Al—Ti intermetallic compound in the interface between the substrate and the aluminum-containing layer, suffered peeling in the bending test. By contrast, Sample Nos. 2 to 6 had a layer of $Al_3Ti$ in the interface between the substrate and the aluminum-containing layer. The layer of $Al_3Ti$ had a thickness of 1–10.5 μm (which meets the requirement for the average thickness of 0.5–15 μm). It also exhibited good adhesion with the substrate without peeling in the bending test. Sample No. 8, however, had a layer of $Al_3Ti$ in the interface between the substrate and the aluminum-containing layer. The layer of $Al_3Ti$ had a thickness of 20 μm (which does not meet the requirement for the average thickness of 0.5–15 μm). Therefore, it suffered partial peeling in the bending test.

Sample No. 7 is an aluminum-clad titanium material, which has a layer (8.6 μm thick) of Al—Ti intermetallic compound (including $Ti_3Al$, TiAl, and $Al_3Ti$) in the interface between the substrate (of pure titanium) and the aluminum sheet. This titanium material suffered partial peeling in the bending test.

After the bending test, the titanium material under-went the high-temperature oxidation test, which gave the results as shown in Table 4. As compared with Sample No. 7 (aluminum-clad titanium material), Sample Nos. 2 to 6 exhibited better oxidation resistance with a less amount of thickness decrease in the high-temperature oxidation test. This suggests that Sample Nos. 2 to 6 are superior in oxidation resistance as well as adhesion between the substrate and the aluminum-containing layer.

Sample Nos. 3 and 4 are particularly superior in oxidation resistance because the $Al_3Ti$ layer has a thickness of 2.5–4.5 μm, which meets the requirement for the thickness from 1 to 5 μm . This suggests that Sample Nos. 3 and 4 are particularly superior in oxidation resistance as well as adhesion between the substrate and the aluminum-containing layer.

It is noted that Sample Nos. 2 to 4 increase in oxidation resistance in proportion to the thickness of the $Al_3Ti$ layer.

Incidentally, Sample No. 1 in Table 4 is similar or identical in structure to Sample No. 1 in Table 2 and Sample Nos. 3 to 5 in Table 1. Therefore the former exhibits as good oxidation resistance as the latter before the bending test which is carried out after the aluminum-containing layer has been formed by hot-dip plating. However, it is noted in Table 4 that Sample No. 1 is poor in oxidation resistance (with a large amount of thickness decrease) in the high-temperature oxidation resistance test which follows the bending test. The reason for this is that the sample suffered peeling in the bending test and the sample with peeling underwent the high-temperature oxidation resistance test which causes thickness decrease by oxidation.

Example 5 and Comparative Example 3

A sheet of pure titanium (measuring 30 cm by 10 cm and 1 mm thick) was dipped in molten aluminum (containing about 2% iron as impurities) at a bath temperature of 700° C. The titanium sheet was pulled up in its lengthwise direction at a rate of 0.05–50 cm/s. The thus obtained titanium material was examined for the thickness of the aluminum-containing layer at an upper part (1 cm away from the top), at an intermediate part (15 cm away from the top), and at a lower part (29 cm away from the top).

The results are shown in Table 5. It is noted that the aluminum-containing layer becomes thicker according as the rate of pulling up from the plating bath increases. This tendency is more noticeable in the lower part. In other words, the difference in thickness increases in going downward.

In the case where the rate of pulling up is 50 cm/s, the difference between the thickness at the upper part and the thickness at the intermediate part is 31.2% [=100×(80–55)/80] of the thickness at the intermediate part, and the difference between the thickness at the intermediate part and the thickness at the lower part is 150% of the thickness at the intermediate part. In the case where the rate of pulling up is 30 cm/s, the difference between the thickness at the upper part and the thickness at the intermediate part is 27.7% of the thickness at the intermediate part, and the difference between the thickness at the intermediate part and the thickness at the lower part is 38.5% of the thickness at the intermediate part.

In the case where the rate of pulling up is 15 cm/s, the difference between the thickness at the upper part and the thickness at the intermediate part is 20% [=100×(55–44)/55] of the thickness at the intermediate part, and the difference between the thickness at the intermediate part and the thickness at the lower part is 18.2% of the thickness at the intermediate part. The percentage in the case of 15 cm/s is smaller than the percentage in the case of 50 cm/s or 30 cm/s.

In the case where the rate of pulling up is 10 cm/s, the difference between the thickness at the upper part and the thickness at the intermediate part and the difference between the thickness at the intermediate part and the thickness at the lower part are smaller than those in the case where the rate of pulling up is 15 cm/s. Likewise, in the case where the rate of pulling up is 2 cm/s, the difference between the thickness at the upper part and the thickness at the intermediate part and the difference between the thickness at the intermediate part and the thickness at the lower part are smaller than those in the case where the rate of pulling up is 10 cm/s.

The rate of pulling up at 15 cm/s, 10 cm/s, or 2 cm/s meets the requirement (specified in the eleventh aspect of the present invention) that the titanium material should be pulled up from the plating bath of molten metal at a rate of 1–20 cm/s. As is apparent from the foregoing and Table 5, the samples meet the requirement (specified in the tenth aspect of the present invention) that when the thickness is measured at three points (14 mm apart) selected in the lengthwise direction of the titanium material on the aluminum-containing layer, the difference between the thickness at the middle point and the thickness at the outer two points should be no larger than 30% of the thickness at the middle point.

In the case where the rate of pulling up is 0.05 cm/s, the difference between the thickness at the upper part and the thickness at the intermediate part is 2% of the thickness at the intermediate part, and the difference between the thickness at the intermediate part and the thickness at the lower part is 6.1% of the thickness at the intermediate part. In other words, the aluminum-containing layer has a uniform thickness but the resulting titanium material becomes thin due to excessive reaction between the titanium substrate and aluminum because the during of dipping greatly differs between the upper part and the lower part.

Example 6 and Comparative Example 4

A sheet of pure titanium (measuring 30 cm by 10 cm and 1 mm thick) was dipped in molten aluminum (containing about 2% iron as impurities) at a bath temperature of 700° C. The titanium sheet was pulled up in its lengthwise direction at a rate of 3 cm/s. The thus obtained titanium material underwent shot blasting with glass beads (as hard particles). The air pressure for blasting was 2 kg/cm$^2$ and the duration of blasting was 10 seconds.

The titanium material which has undergone shot blasting is designated as "titanium material A". For oxidation test, this sample was exposed to the atmosphere at 800° C. for 100 hours. The oxidation resistance of the sample was evaluated from the change in mass measured before and after the oxidation test. A second sample designated as "titanium material B" was prepared in the same way as mentioned above except that it did not undergo shot blasting. The oxidation resistance of this sample was evaluated in the same way as mentioned above.

It was found that "titanium material B" gained a weight of 3 mg/cm$^2$ due to oxidation, whereas "titanium material A" gains a weight of 1.9 mg/cm$^2$ due to oxidation. Apparently, the latter is superior to the former in oxidation resistance.

These samples were examined for surface state by visual observation. "Titanium material A" (with shot blasting) looked better (owing to a metallic luster) than "titanium material B" (without shot blasting).

TABLE 1

| No. | Oxidation resistance layer | Composition | Method of preparation | Al-Ti layer | Decrease in thickness (μm) | Example for |
|---|---|---|---|---|---|---|
| 1 | None | — | — | — | 200 | comparison |
| 2 | Al | $Al_{100}$ | Hot-dip plating | yes | 50 | — |
| 3 | Al | $Al_{100}$ | Spraying | no | 50 | — |
| 4 | Al-Ti | $Al_{95}Ti_5$ | Vapor deposition | no | 65 | — |
| 5 | Al-Ti | $Al_{85}Ti_{15}$ | Vapor deposition | no | 150 | comparison |
| 6 | Al-Si | $Al_{95}Si_5$ | Hot-dip plating | yes | 52 | — |
| 7 | Al-Si | $Al_{85}Si_{15}$ | Hot-dip plating | yes | 125 | — |
| 8 | Al-Fe | $Al_{95}Fe_5$ | Hot-dip plating | yes | 60 | — |

TABLE 2

| No. | Substrate | Oxidation resistance layer | Composition | Method of preparation | Bending test | Decrease in thickness (μm) | Example for |
|---|---|---|---|---|---|---|---|
| 1 | Pure Ti | Al | $Al_{100}$ | Hot-dip plating | Peeled | 50 | — |
| 2 | Ti-1.5Al | Al | $Al_{100}$ | Hot-dip plating | Peeled | 48 | — |
| 3 | Ti-3Al-2.5V | Al | $Al_{100}$ | Hot-dip plating | Peeled | 46 | — |
| 4 | Ti-6Al-4V | Al | $Al_{100}$ | Hot-dip plating | Peeled | 51 | — |
| 5 | Ti-6Al-2Sn-4Zr-2Mo | Al | $Al_{100}$ | Hot-dip plating | Peeled | 48 | — |
| 6 | Ti-15Al | Al | $Al_{100}$ | Hot-dip plating | Substrate cracked | Not evaluated | comparison |

TABLE 3

| No. | Substrate | Content of nitrogen in surface layer (atomic %) | Aluminum nitride layer | Oxidation resistance layer | Composition | Method of preparation | Decrease in thickness (μm) | Example for |
|---|---|---|---|---|---|---|---|---|
| 1 | Ti-1.5Al | 0 | No | Al | $Al_{100}$ | Hot-dip plating | 48 | — |
| 2 | Ti-1.5Al | 2 | No | Al | $Al_{100}$ | Hot-dip plating | 48 | — |
| 3 | Ti-1.5Al | 15 | No | Al | $Al_{100}$ | Hot-dip plating | 42 | — |
| 4 | Ti-1.5Al | 27 | Yes | Al | $Al_{100}$ | Hot-dip plating | 31 | — |
| 5 | Ti-1.5Al | 35 | Yes | Al | $Al_{100}$ | Hot-dip plating | 27 | — |
| 6 | Ti-1.5Al | 48 | Yes | Al | $Al_{100}$ | Hot-dip plating | 20 | — |
| 7 | Pure Ti | 0 | No | Al | $Al_{100}$ | Hot-dip plating | 50 | — |
| 8 | Pure Ti | 2 | No | Al | $Al_{100}$ | Hot-dip plating | 50 | — |
| 9 | Pure Ti | 15 | No | Al | $Al_{100}$ | Hot-dip plating | 43 | — |
| 10 | Pure Ti | 27 | Yes | Al | $Al_{100}$ | Hot-dip plating | 33 | — |
| 11 | Pure Ti | 35 | Yes | Al | $Al_{100}$ | Hot-dip plating | 29 | — |
| 12 | Pure Ti | 48 | Yes | Al | $Al_{100}$ | Hot-dip plating | 22 | — |

TABLE 4

| No. | Substrate | Duration of dipping (min) | Al-Ti compound | Thickness | Bending test | Decrease in thickness (μm) |
|---|---|---|---|---|---|---|
| 1 | Pure Ti | 0.1 | None (with residual oxide film) | 0 | Peeled | 200 |
| 2 | Pure Ti | 3 | $Al_3Ti$ | 1 | Not peeled | 75 |
| 3 | Pure Ti | 5 | $Al_3T$ | 2.5 | Not peeled | 55 |
| 4 | Pure Ti | 20 | $Al_3T$ | 4.5 | Not peeled | 48 |
| 5 | Pure Ti | 45 | $Al_3T$ | 7.8 | Not peeled | 67 |
| 6 | Pure Ti | 60 | $Al_3T$ | 10.5 | Not peeled | 75 |
| 7 | Pure Ti | — | $Ti_3Al$, TiAl, $Al_3Ti$ | 8.6 | Partially peeled | 175 |
| 8 | Pure Ti | 90 | $Al_3T$ | 20 | Partially peeled | 175 |

Remarks: No. 7 = Al-clad titanium material

TABLE 5

| Rate of pulling up (cm/s) | Position where thickness is measured, thickness in μm | | |
|---|---|---|---|
| | Upper part | Middle part | Lower part |
| 0.05 | 48 (0.97)* | 45 | 52 (1.06)* |
| 2 | 45 (0.9) | 50 | 55 (1.1) |
| 10 | 43 (0.82) | 52 | 57 (1.1) |
| 15 | 44 (0.8) | 55 | 65 (1.18) |
| 30 | 47 (0.72) | 65 | 90 (1.38) |
| 50 | 55 (0.68) | 80 | 200 (2.5) |

Remarks:
Ratio of the film thickness at the upper or lower part to the film thickness at the middle part.

What is claimed is:

1. A titanium material comprising:

a substrate of pure titanium or titanium alloy; and an aluminum-containing layer formed at least partly on the surface of the substrate, said aluminum-containing layer having a thickness no smaller than 1 μm and containing no less than 90 mass % aluminum or aluminum plus silicon.

2. The titanium material as defined in claim 1, wherein the aluminum-containing layer is formed directly on the substrate.

3. The titanium material as defined in claim 1, wherein the aluminum-containing layer is formed indirectly on the substrate, with a layer of Al—Ti intermetallic compound interposed between them.

4. The titanium material as defined in claim 3, wherein the Al—Ti intermetallic compound is $Al_3Ti$.

5. The titanium material as defined in claim 3, wherein the layer of Al—Ti intermetallic compound has an average thickness no smaller than 0.5 μm and no larger than 15 μm.

6. The titanium material as defined in claim 1, wherein the substrate is a titanium-based alloy containing 0.5–10 mass % aluminum.

7. The titanium material as defined in claim 6, wherein the substrate is a titanium-based alloy composed substantially of aluminum and titanium.

8. The titanium material as defined in claim 1, wherein that surface of the substrate with which the aluminum-containing layer is in contact contains 20–50 atomic % nitrogen.

9. The titanium material as defined in claim 1, wherein a layer of aluminum nitride is formed in the interface between the substrate and the aluminum-containing layer.

10. The titanium material as defined in claim 1, wherein the aluminum-containing layer is one which is formed by hot-dip plating.

11. The titanium material as defined in claim 1, wherein the aluminum-containing layer has a thickness such that, when the thickness is measured at three points (14 mm apart) selected in the lengthwise direction of the titanium material on the aluminum-containing layer, the difference between the thickness at the middle point and the thickness at the outer two points is no larger than 30% of the thickness at the middle point.

12. A method for producing the titanium material defined in claim 11, said method comprising forming the aluminum-containing layer by hot-dip plating, which involves the dipping of the substrate in a plating bath of molten metal, in such a way that the substrate is pulled up from the plating bath at a rate of 1–20 cm/s.

13. A method for producing the titanium material defined in claim 1, said method comprising forming the aluminum-containing layer by hot-dip plating, which involves the dipping of the substrate in a plating bath of molten metal, and subsequently performing shot blasting with hard particles.

14. An exhaust pipe made of the titanium material defined in claim 1.

* * * * *

UNITED STATES PATENT AND TRADEMARK OFFICE

CERTIFICATE OF CORRECTION

PATENT NO. : 6,984,457 B2
DATED : January 10, 2006
INVENTOR(S) : Yamamoto et al.

It is certified that error appears in the above-identified patent and that said Letters Patent is hereby corrected as shown below:

Title page,
Item [73], Assignee, should read:
-- [73] Assignee: Kabushiki Kaisha Kobe Seiko Sho
(Kobe Steel, Ltd.), Kobe (JP) --.

Signed and Sealed this

Twenty-first Day of March, 2006

JON W. DUDAS
*Director of the United States Patent and Trademark Office*